US009265694B2

(12) United States Patent
Ji et al.

(10) Patent No.: US 9,265,694 B2
(45) Date of Patent: Feb. 23, 2016

(54) BATHTUB HAVING MASSAGE FEATURES

(71) Applicant: Shanghai Kohler Electronics, Ltd., Shanghai (CN)

(72) Inventors: Yong Ji, Shanghai (CN); Zhongmin Chen, Shanghai (CN)

(73) Assignee: SHANGHAI KOHLER ELECTRONICS, LTD. (CN)

( * ) Notice: Subject to any disclaimer, the term of this patent is extended or adjusted under 35 U.S.C. 154(b) by 459 days.

(21) Appl. No.: 13/722,538

(22) Filed: Dec. 20, 2012

(65) Prior Publication Data

US 2013/0160199 A1 Jun. 27, 2013

(30) Foreign Application Priority Data

Dec. 22, 2011 (CN) ..... 2011 2 0544905 U

(51) Int. Cl.

*A61H 33/00* (2006.01)
*A61H 23/02* (2006.01)
*A61H 33/02* (2006.01)

(52) U.S. Cl.

CPC ..... *A61H 33/0087* (2013.01); *A61H 23/0245* (2013.01); *A61H 33/60* (2013.01); *A61H 33/02* (2013.01)

(58) Field of Classification Search

CPC ..... A61H 23/0245; A61H 33/0087; A61H 2033/0029
USPC ..... 4/541.6
See application file for complete search history.

(56) References Cited

U.S. PATENT DOCUMENTS 5,056,168 A * 10/1991 Mersmann ..... 4/541.6
5,178,134 A * 1/1993 Vago ..... 601/2
5,702,353 A 12/1997 Guzzini et al.

FOREIGN PATENT DOCUMENTS

CN 96104628.7 11/1996

* cited by examiner

*Primary Examiner* — Janie Christiansen
(74) *Attorney, Agent, or Firm* — Foley & Lardner LLP

(57) ABSTRACT

The present invention application provides a bathtub. On the bathtub wall are fixed ultrasonic transmitters, and an ultrasonic transducer drive circuit is electrically connected to ultrasonic transducers. The ultrasonic transmitters further include an ultrasonic divergent structure which, after reflecting and scattering the ultrasonic waves emitted by the ultrasonic transducers, transmits the same into the bathtub (e.g., into the water of the tub).

18 Claims, 6 Drawing Sheets

BATHTUB HAVING MASSAGE FEATURES

CROSS-REFERENCE TO RELATED PATENT APPLICATIONS

This application claims the benefit of and priority to Chinese Patent Application No. 201120544905.7, filed Dec. 22, 2011, the entirety of which is incorporated herein by reference.

BACKGROUND

The present application relates to a bathtub. Some bathtubs include ultrasonic generators which emit ultrasonic waves that cause the fluid in the bathtub to vibrate. This fluid vibration may be transmitted to the skin or muscles of a person in the bathtub, producing health benefits such as those associated with massage. It is challenging and difficult to direct ultrasonic waves throughout the bathtub in an effective manner.

SUMMARY

Embodiments of the present invention relate to a bathtub with ultrasonic transmitters. More particularly, the bathtub wall may include fixed-position ultrasonic transmitters. An ultrasonic transducer drive circuit may be electrically connected to the ultrasonic transmitters. Massage jets may also be fixed on the bathtub wall. The massage jets may be connected to a water pump or air pump. The ultrasonic transmitters may include ultrasonic transducers. The ultrasonic transducer drive circuit may be electrically connected to the ultrasonic transducers. The ultrasonic transducers may be provided with electrical energy by the ultrasonic transducer drive circuit. The ultrasonic transducers may convert the electrical energy into ultrasonic waves. The ultrasonic transmitters may include an ultrasonic divergent structure configured to reflect and scatter the ultrasonic waves emitted by the ultrasonic transducers. The ultrasonic transducers may be fixed on the ultrasonic divergent structure.

The ultrasonic divergent structure may include a reflector dish. The top part of the reflector dish may be located along the inner edge of the bathtub wall. The bowl part of the reflector dish may be located along the outer edge of the bathtub wall and a front cover. The front cover may be fastened to the reflector dish top. The ultrasonic transducers may be fixed on the front cover so that the ultrasonic transducers face the inner surface of the reflector dish bowl.

In an exemplary embodiment, on the outer wall of the reflector dish bowl are fitted external threads and nuts screwed thereon, so as to firmly fasten the reflector dish bowl to the outer edge of the bathtub wall. The periphery of the reflector dish top and the edge of the front cover may be fitted with screws, so as to secure the front cover and reflector dish top to each other. The ultrasonic transducers may be fastened to the front cover by a fixed block. A first sealing ring may be installed in the gap between the inner edge of the bathtub wall and the reflector dish top. A second sealing ring may be further installed in the gap between the reflector dish top and the inner edge of the bathtub wall, the second sealing ring being larger in size than the first ring. The inner surface of the reflector dish bowl may be parabolic, hyperbolic, or spherical.

More preferably, a passage is fitted which passes through the reflector dish and extends toward the front cover, and a wire leads from the ultrasonic transducer, extending through the front cover, and subsequently extending out the reflector dish, ultimately connecting to the ultrasonic transducer drive circuit. The front cover may be provided with one or more perforations. The perforations may be arrayed concentrically.

According to some exemplary embodiments, a bathtub with fixed ultrasonic transmitters is advantageously configured to cause most of the ultrasonic waves emitted by the ultrasonic transducers to only undergo one reflection and scattering, effectively increasing the power of ultrasound divergence, and avoiding the creation of secondary focal points.

The present invention application provides a bathtub, on the bathtub wall are fixed ultrasonic transmitters, and an ultrasonic transducer drive circuit is electrically connected to ultrasonic transducers. Massage jets are fixed on the bathtub wall. The massage jets are connected to a water pump or air pump. The ultrasonic transmitters includes ultrasonic transducers. The ultrasonic transducer drive circuit is electrically connected to said ultrasonic transducers. The ultrasonic transducers are provided with electrical energy by the ultrasonic transducer drive circuit and convert the electrical energy into ultrasonic waves. The ultrasonic transmitters further include an ultrasonic divergent structure which, after once reflecting and scattering the ultrasonic waves emitted by the ultrasonic transducers, transmits the ultrasonic waves into the bathtub. The ultrasonic transducers are fixed on the ultrasonic divergent structure. Embodiments constructed according to the present application may advantageously provide a bathtub that is simple in structure, has high divergence efficiency, and does not generate a secondary focal point.

DETAILED DESCRIPTION

In the following description, use of the same numbers denotes reference to the same components. The numerals and text are presented by way of example and are not intended to limit the scope of the appended claims.

Figure 1:
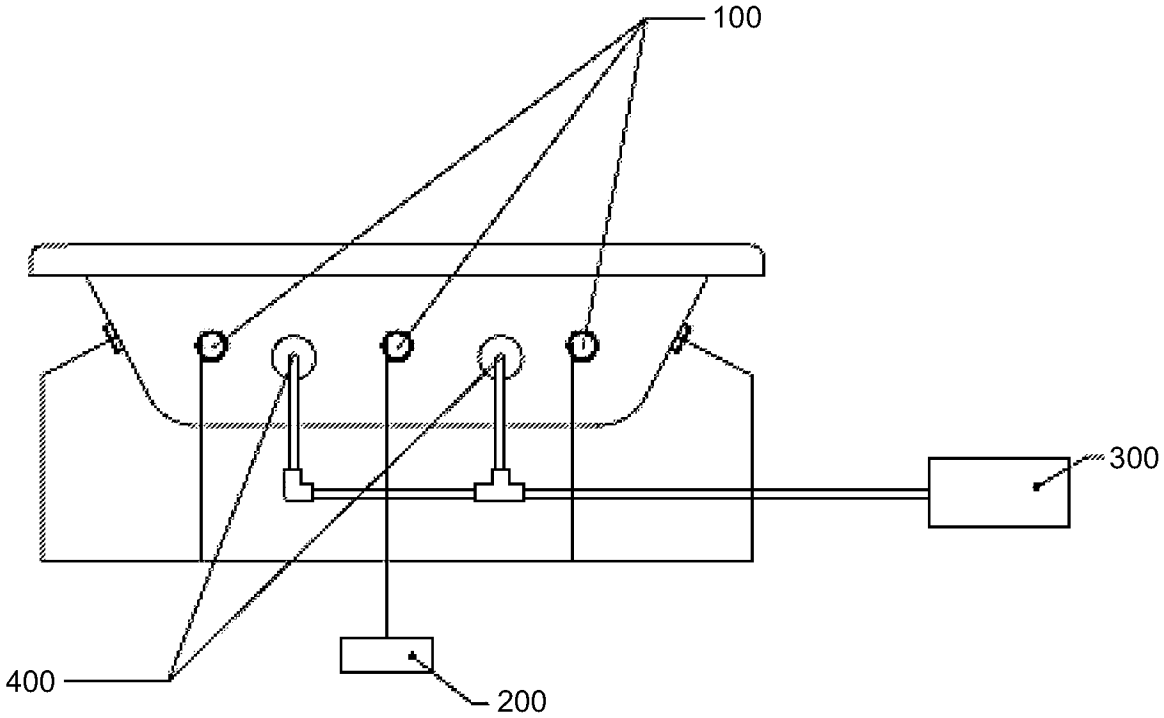
FIG. 1 is a schematic of a bathtub having ultrasonic transmitters, according to an exemplary embodiment.

FIG. 1 is a schematic diagram of a bathtub, according to an exemplary embodiment. As shown in FIG. 1, on the bathtub wall are fixed ultrasonic transmitters 100. Ultrasonic transmitters 100 are connected to ultrasonic transducer drive circuit 200. The ultrasonic transducer drive circuit 200 controls the ultrasonic waves generated by ultrasonic transmitters 100. The transmitters thereby direct the ultrasonic waves into the fluid within the bathtub. Massage jets 400 are also fixed on the bathtub wall. The massage jets 400 are connected to a water pump or air pump 300. The water pump or air pump 300 provides fluid movement within the bathtub via the massage jets 400.

Each ultrasonic transmitter 100 includes an ultrasonic transducer and an ultrasonic divergent structure. The ultrasonic transducer drive circuit 200 is connected to the ultrasonic transducers and provides power to the ultrasonic transducers. The ultrasonic transducers convert received electrical energy into ultrasonic waves, which take the form of a narrow parallel cylindrical beam. The narrow parallel cylindrical beam may be reflected and scattered by the ultrasonic divergent structure so as to be converted into a broad hollow conical beam. The broad hollow conical beam is directed into the fluid within the bathtub to form fluid vibration. Preferably, the ultrasonic transducer drive circuit 200 can utilize different drive signals and switching intervals, so as to control the ultrasonic transducers to generate different ultrasonic fluctuation effects.

Figure 2:
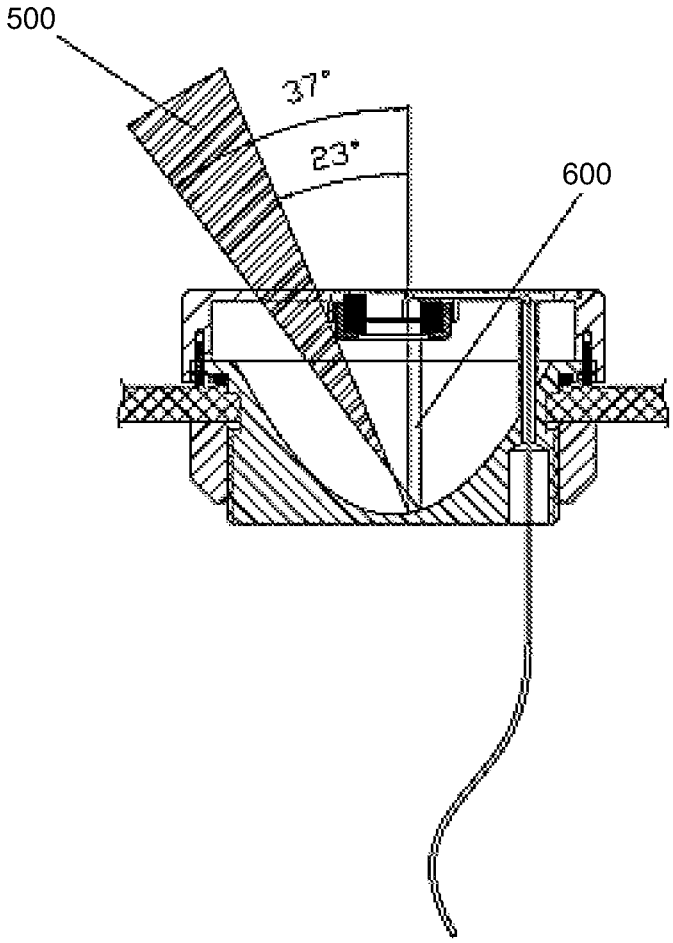
FIG. 2 shows a cutaway view of the ultrasonic transmitter, and the path for ultrasonic waves generated by the transmitter, according to an exemplary embodiment.

FIG. 2 is a diagram showing a cutaway view of the ultrasonic transmitter of FIG. 1, according to an exemplary embodiment. The view of FIG. 2 illustrates an exemplary path of the ultrasonic waves output by the transmitter. As shown, the narrow parallel cylindrical beam 600 emitted from the ultrasonic transducer is transmitted to the inner surface of the reflector dish of the ultrasonic divergent structure, and after undergoing reflection and scattering in the inner surface of the reflector dish, a broad hollow conical beam 500 is formed. In the embodiment shown in FIG. 2, the solid angle of the outside of the broad hollow conical beam relative to the reflector dish inner surface is 37°, while the solid angle of the inside is 23°. However, it may be understood that the solid angles of the broad hollow conical beam are not limited to the above values. The geometry of the reflector dish can be different than that shown, according to varying exemplary embodiments.

Figure 3:
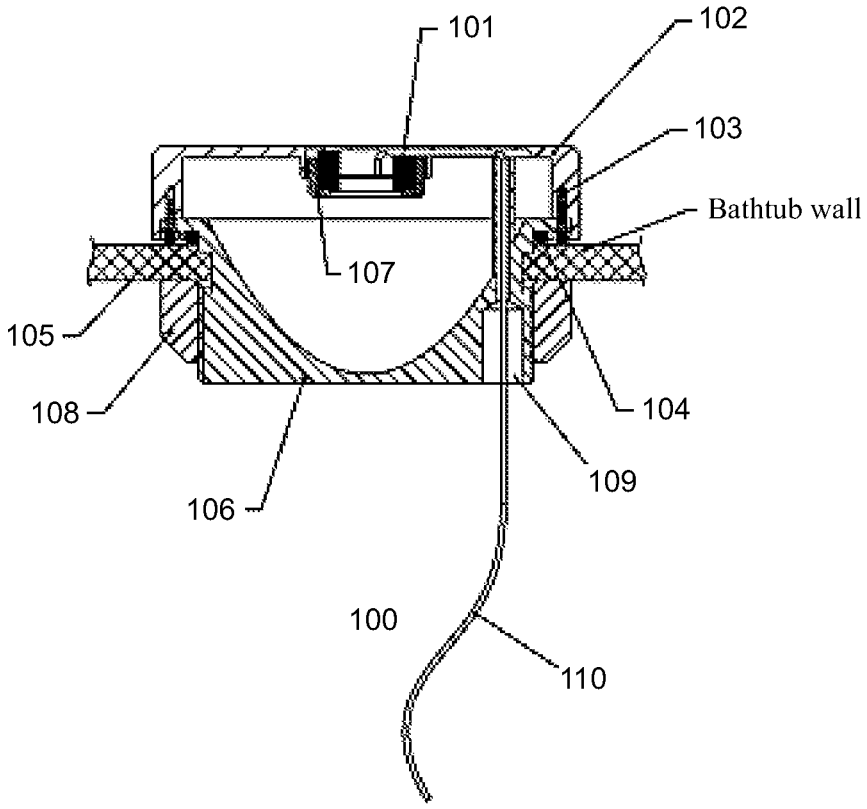
FIG. 3 shows another cutaway view of the ultrasonic transmitter of FIGS. 1 and 2, according to an exemplary embodiment.

FIG. 3 shows a cutaway view of the ultrasonic transmitter in the present application. As shown in FIG. 3, the top of the main part of the ultrasonic divergent structure—the reflector dish 106—is lodged along the inner edge of the bathtub wall, while the bowl of the reflector dish 106 is lodged along the outer edge of the bathtub wall. Preferably, external threads are fitted onto the outer walls of the bowl of reflector dish 106, and nuts 108 are screwed in along the external threads, so as to firmly fasten the reflector dish bowl to the outer edge of the bathtub wall.

The front cover 102 of the ultrasonic divergent structure is fastened to the top part of the reflector dish 106. In particular, the screws 103 may be screwed into the periphery of the reflector dish top and the edge of front cover 102, so as to firmly secure the front cover 102 and the reflector dish top to each other.

The ultrasonic transducers 101 are fastened onto front cover 102, for example, via fixed block 107, so as to ensure the ultrasonic transducers 101 face toward the inner surface of the reflector dish 106 bowl. As a result, the ultrasonic beams emitted by ultrasonic transducers 101 will be reflected and scattered on the inner surface of the reflector dish bowl. The inner surface bowl of the reflector dish 106 as shown in FIG. 3 takes a parabolic shape. However, it may be understood that other configurations may be designed according to varying dispersion patterns of varying embodiments. For example, the reflector dish may take a hyperbolic shape or a semi-spherical shape.

Figure 6:
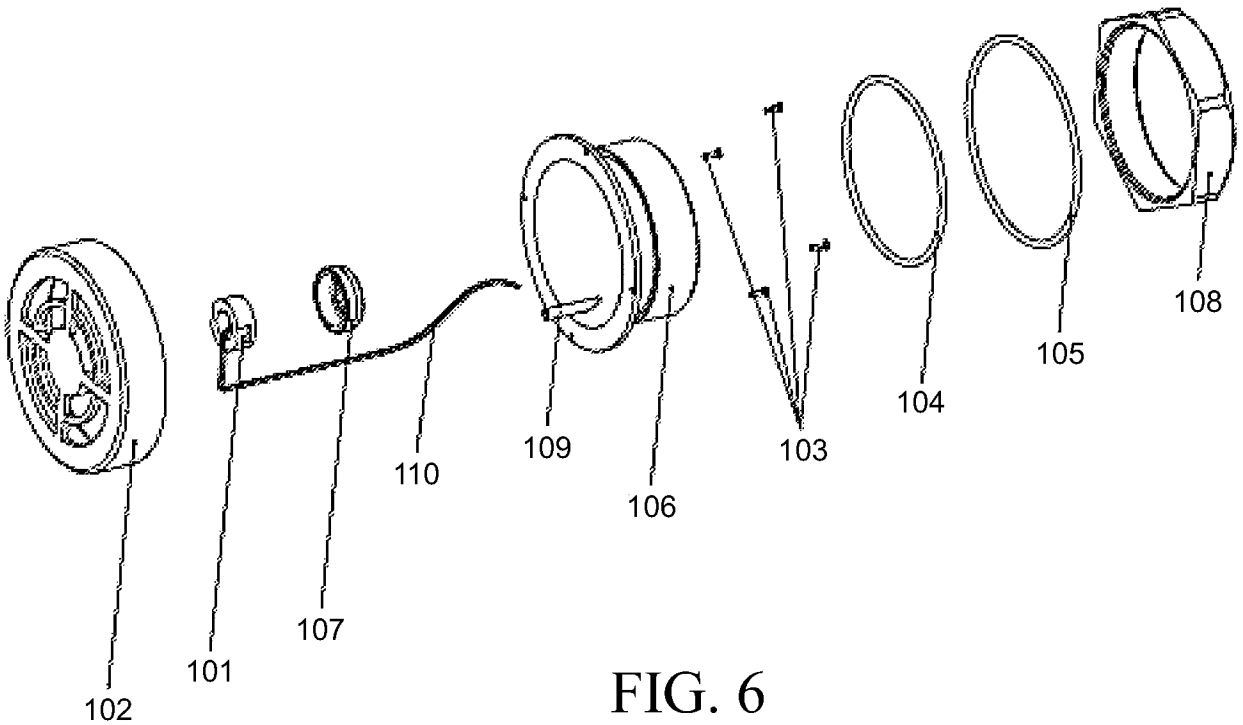
FIG. 6 shows an exploded view of the ultrasonic transmitter of FIG. 5, according to an exemplary embodiment.

As illustrated in FIG. 3 and again in FIG. 6, a first sealing ring 104 is installed in the gap between the inner edge of the bathtub wall and the top part of the reflector dish 106. The first sealing ring 104 may function to enhance the sealing of the ultrasonic divergent structure and may effectively prevent fluid inside the bathtub from infiltrating into the ultrasonic transmitters. Further, a second sealing ring 105 may be further installed in the gap between the top part of the reflector dish 106 and the inner edge of the bathtub wall, further enhancing the sealing of the ultrasonic divergent structure. As shown in FIGS. 3 and 6, the second sealing ring 105 is larger in size than the first ring 104.

A passage 109 that runs through the reflector dish 106 and extends toward the front cover 102 may further be provided. The passage 109 allows a wire 110 leading from ultrasonic transducer 101 to extend along passage 109 through the front cover 102 and out of the reflector dish 106. Poured glue may be used to seal at the passage 109. The wire 110 may connect the ultrasonic transducer 101 to the ultrasonic transducer drive circuit 200. By virtue of the connecting wire 110, the drive circuit can effectively control the ultrasonic transducer 101 in converting electrical energy to ultrasound.

Figure 4:
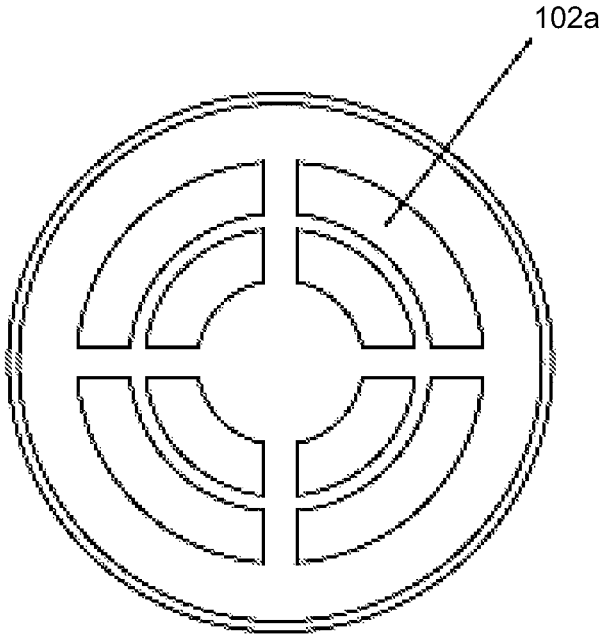
FIG. 4 shows a top view of the ultrasonic transmitter according to the embodiment of FIG. 3.

FIG. 4 shows a top view of the ultrasonic transmitter according to the embodiment of FIG. 3. As shown in FIG. 4, when observing from above, front cover 102 shields from view the other parts of the ultrasonic transmitter. As such, FIG. 4 actually shows the top surface of the front cover 102. One or more perforations 102*a* are provided in front cover 102, to allow the passage of ultrasonic waves. FIG. 4 shows a plurality of perforations 102*a* arrayed in a concentric arrangement. However, it may be understood that other patterns of arranging the perforations 102*a* are possible according to the actual circumstances.

Figure 5:
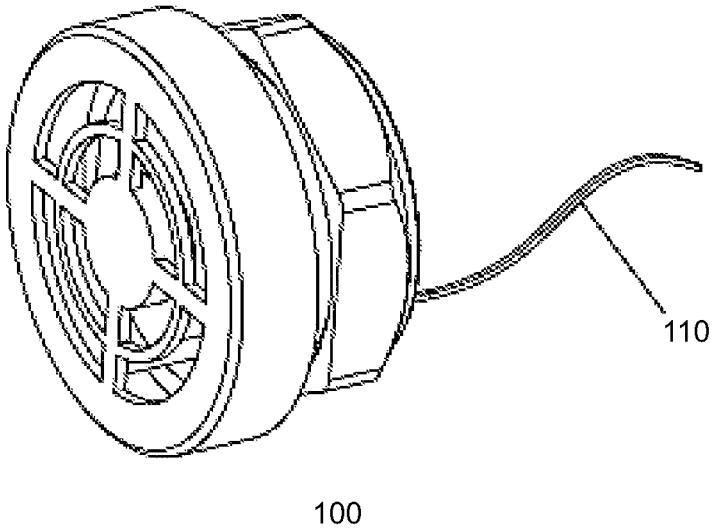
FIG. 5 shows a perspective view of a fully assembled ultrasonic transmitter of FIGS. 1-4, according to an exemplary embodiment.

FIG. 5 shows a 3D view of the fully assembled ultrasonic transmitter according to the present application. As shown in FIG. 5, a wire 110 as described previously leads from one side of the ultrasonic transmitter.

FIG. 6 shows a schematic of the spatial relationship between each yet to be assembled component of the ultrasonic transmitter according to the present application. From left to right in FIG. 6 are shown the front cover 102, the ultrasonic transducer 101 (including the wire 110 leading therefrom), the fixed block 107, the reflector dish 106 (including the conductor passage 109 that is structurally a part thereof), screws 103, first sealing ring 104, second sealing ring 105, and nuts 108. The assembled relationship of each of these components is described in the above description of FIG. 3.

According to the embodiment illustrated in FIGS. 3-6, the ultrasonic transducer drive circuit 200 controls the ultrasonic transducers 101 via conductor wire 110, causing ultrasonic transducers 101 to emit a narrow parallel cylindrical beam. The narrow parallel cylindrical ultrasonic beam is transmitted to the inner surface of the bowl of reflector dish 106, where it is reflected and scattered into a broad hollow conical beam. The broad hollow conical beam travels through the front cover 102 into the bathtub interior, causing the fluid therein to vibrate in the bathtub, thus accomplishing the massage etc. of a person in the bathtub.

In an exemplary embodiment, most of the ultrasonic waves emitted by the ultrasonic transducers only undergo one reflection and scattering, effectively increasing the power of ultrasound divergence, and therefore a secondary focal point is not generated (which may be desired to be avoided).

What is claimed is:

1. A bathtub comprising:

bathtub walls and fixed ultrasonic transmitters on one or more of the bathtub walls, and an ultrasonic transducer drive circuit electrically connected to the ultrasonic transmitters;

fixed massage jets on one or more of the bathtub walls, the massage jets being connected to a water pump or air pump;

wherein the ultrasonic transmitters comprise ultrasonic transducers and the ultrasonic transducer drive circuit is electrically connected to said ultrasonic transducers, which are provided with electrical energy by the ultrasonic transducer drive circuit, and wherein the ultrasonic transducers operate to convert the electrical energy into ultrasonic waves;

wherein the ultrasonic transmitters further comprise an ultrasonic divergent structure, which, after reflecting and scattering the ultrasonic waves emitted by the ultrasonic transducers, transmits the scattered ultrasonic waves into the bathtub;

wherein the ultrasonic transducers have an axis of transmission offset from a central axis of the ultrasonic divergent structure and emit cylindrical beams in a direction parallel to the central axis and away from an interior of the bathtub;

wherein the ultrasonic divergent structure scatters the cylindrical beams to form conical beams and reflects the conical beams toward the interior of the bathtub, the conical beams having an axis oriented at an angle relative to the central axis.

2. The bathtub as recited in claim 1, wherein the ultrasonic transducers are fixed on the ultrasonic divergent structure.

3. The bathtub as recited in claim 2, wherein the ultrasonic divergent structure comprises a reflector dish, wherein a top part of the reflector dish is located along an inner edge of the bathtub wall, and a bowl part of the reflector dish is located along an outer edge of the bathtub wall.

4. The bathtub as recited in claim 3, wherein the ultrasonic divergent structure further comprises a front cover fastened to said reflector dish top, wherein said ultrasonic transducers are fixed on the front cover so that the ultrasonic transducers face an inner surface of the reflector dish bowl.

5. The bathtub as recited in claim 4, wherein an outer wall of the reflector dish bowl comprises fitted external threads for fastening the reflector dish bowl to the outer edge of the bathtub wall.

6. The bathtub as recited in claim 5, wherein a periphery of the reflector dish top and an edge of the front cover are fitted with fasteners so as to secure the front cover and reflector dish top to each other.

7. The bathtub as recited in claim 6, wherein the front cover is provided with one or more perforations.

8. The bathtub as recited in claim 7, wherein the perforations are arrayed concentrically.

9. The bathtub as recited in claim 8, wherein the ultrasonic transducers are fastened to the front cover by a fixed block.

10. The bathtub as recited in claim 9, wherein a first sealing ring is installed in a gap between the inner edge of the bathtub wall and the reflector dish top.

11. The bathtub as recited in claim 10, wherein a second sealing ring is further installed in a gap between the reflector dish top and the inner edge of the bathtub wall, the second sealing ring being larger in size than the first ring.

12. The bathtub as recited in claim 1, wherein an inner surface of the reflector dish bowl is at least one of parabolic, hyperbolic, and spherical.

13. The bathtub as recited in claim 1, wherein a passage passes through the reflector dish and extends toward a front cover, and a wire leads from the ultrasonic transducer, extending through the front cover, and subsequently extending out the reflector dish, ultimately connecting to the ultrasonic transducer drive circuit.

14. An ultrasonic transmitter for fitting to a bathtub, comprising:

a mount for fitting the transmitter to the bathtub;

a dish;

an ultrasonic transducer coupled to the dish such that the ultrasonic transducer is aimed into the dish and emits a cylindrical beam of ultrasonic waves along an axis of transmission offset from a central axis of the dish and parallel to the central axis;

wherein the dish is shaped to reflect and scatter the cylindrical beam of ultrasonic waves received from the ultrasonic transducer to form a conical beam of ultrasonic waves having an axis oriented at an angle relative to the central axis, wherein the dish reflects the conical beam into an interior of the bathtub when the ultrasonic transmitter is mounted to the bathtub.

15. The ultrasonic transmitter of claim 14, wherein the dish is concave relative to the interior of the bathtub.

16. The ultrasonic transmitter of claim 15, wherein the ultrasonic transducer is aimed away from the interior of the bathtub.

17. A bathtub comprising:

at least one ultrasonic transmitter coupled to a wall of the bathtub and aimed into the wall of the bathtub;

a dish mounted at least partially within the wall of the bathtub and configured to receive the ultrasonic waves from the ultrasonic transmitter;

wherein the dish is a concave dish relative to the ultrasonic transmitter and is configured to catch, reflect, and scatter the received ultrasonic waves into water held by the bathtub;

wherein the ultrasonic transmitter has an axis of transmission offset from a central axis of the dish and emits a cylindrical beam in a direction parallel to the central axis and away from an interior of the bathtub;

wherein the dish scatters the cylindrical beam to form a conical beam and reflects the conical beam toward the interior of the bathtub, the conical beam having an axis oriented at an angle relative to the central axis.

18. The bathtub of claim 17, wherein the dish prevents the ultrasonic waves of the transmitter from focusing.

* * * * *